United States Patent [19]

Guenst

[11] Patent Number: 4,922,229

[45] Date of Patent: May 1, 1990

[54] SYSTEM FOR RETRIEVING AND PREVENTING THE LOSS OR THEFT OF KEYS

[76] Inventor: Gary Guenst, 4110 Colonial Ct., P.O. Box 744, Skippack, Pa. 19474

[21] Appl. No.: 350,492

[22] Filed: May 11, 1989

[51] Int. Cl.[5] ..... G08B 13/18; G08B 21/00

[52] U.S. Cl. ..... 340/572; 340/539; 340/571; 340/825.36

[58] Field of Search ..... 340/572, 539, 571, 825.36, 340/825.44, 825.49

[56] References Cited

U.S. PATENT DOCUMENTS

| | | | |
|---|---|---|---|
| 3,825,833 | 7/1974 | Bogue et al. | 340/539 |
| 4,352,097 | 9/1982 | Hamann | 340/572 |
| 4,476,469 | 10/1984 | Lander | 340/539 |
| 4,507,653 | 3/1985 | Bayer | 340/571 |
| 4,595,922 | 6/1986 | Cobb et al. | 340/825.49 |
| 4,598,275 | 7/1986 | Ross et al. | 340/573 |
| 4,818,973 | 4/1989 | Yamakawa et al. | 340/572 |

*Primary Examiner*—Glen R. Swann, III
*Attorney, Agent, or Firm*—Caesar, Rivise, Bernstein, Cohen & Pokotilow, Ltd.

[57] ABSTRACT

A system for retrieving and preventing loss or theft of keys which provide access to drugs or narcotics in a hospital or other health care facility is described. The drugs are placed in a strong box, requiring two keys to open, mounted on a cart, which can be taken to nursing stations for the administration of the drugs. Mounted adjacent the strong box is a call unit, which includes a call button, transmitter, and beeper so that if one or both of the keys are required to open the strong box, depressing the button will operate the transmitter, which will cause a beeper to sound at the key to advise the holder of the key to return to the cart. The key contains a receiver/transmitter and beeper. Furthermore, to prevent inadvertent or purposeful removal of the key from the facility, a detection unit is installed at exit locations. The detection unit transmits a signal, which is received by the key, and which in turn transmits a return signal to the detection unit. The signal received by the detection unit is transmitted over facility's wiring to a central location, which includes an audible alarm and an indicator showing the exit through which the key is being transported.

23 Claims, 3 Drawing Sheets

SYSTEM FOR RETRIEVING AND PREVENTING THE LOSS OR THEFT OF KEYS

BACKGROUND OF THE INVENTION

This invention relates to systems for retrieving keys and, more particularly, to systems for retrieving and preventing the loss or theft of keys allowing access to narcotics in hospitals and other health care facilities.

With the growing proliferation of the illicit use of drugs and narcotics, it is important that the security means in hospitals and other health care facilities for restricting access to said narcotics, while at the same time making them readily available to patients at the facilities, be maintained and strengthened.

Hospitals and other health care facilities use a multiple key and lock system for control of access to drugs. Thus, it takes two keys to open the strong box or cabinet in which the drugs are kept. However, a problems exists in that often when the drugs are required for dispensing to patients, the person(s) with one or both of the keys cannot be located. Furthermore, inadvertently carrying the keys out of the facility can cause a problem with regard to proper access to the drugs, or the theft of the keys may lead to illicit access to the drugs.

Various types of locating systems exist. Bogue, et al., U.S. Letters Pat. No. 3,825,833, discloses a signalling device, which is used to summon help when the carrier is in distress. Hamann, U.S. Letters Pat. No. 4,352,097, discloses an anti-theft system for protection of a bag of valuables, which gives an alarm in the case of attempted theft. A receiving unit in the bag receives a transmitted signal continuously, and the security apparatus is put into operation if the transmitter signal is no longer received.

Bayer, U.S. Letters Pat. No. 4,507,653, discloses a unit adapted to be attached to an article, such as a key, which includes a receiver responsive to a transmitted signal from a clap, whistle, or other loud noise for identifying the location of the article. Lander, U.S. Letters Pat. No. 4,476,469, discloses a locator device for ascertaining the location of various objects. In one embodiment, a beeper is attached to a key ring, which has a receiver for receiving the signal from the searching device and emits a signal in response to the signal from the searching device, which assists in locating the key ring.

Ross, et al., U.S. Letters Pat. No. 4,598,275, teaches a system for monitoring the movement of individuals. The system includes a plurality of remote detector modules at selected exit locations and utilizes a plurality of personalized identifier units (e.g., bracelets) worn by the individuals to be monitored.

Although the existing devices disclosed above may be suitable for the purposes for which they are intended, there is no teaching of using these devices to retrieve the keys by instructing the carrier of keys to return the keys to a specified location or alerting the carrier of keys to the fact that he or she is inadvertently removing the key from a hospital or other health care facility. Furthermore, if a person is intent on theft of the key, the instant invention will alert personnel at a centralized monitoring location to the fact that the key is being carried through an exit of the facility.

OBJECTS OF THE INVENTION

Accordingly, it is the general object of this invention to provide a system for retrieving and preventing the loss or theft of keys.

It is a further object of this invention to provide a system for retrieving and preventing the loss or theft of keys which allow access to drugs or narcotics in a hospital or other health care facility.

It is still a further object of this invention to provide a system for retrieving and preventing the loss or theft of keys whereby personnel in hospitals or other health care facilities may retrieve the keys by summoning the carrier(s) of keys allowing access to drugs or narcotics to the location of the drugs or narcotics.

It is still yet a further object of this invention to provide a system for retrieving and preventing the loss or theft of keys which includes a signal alerting the carrier(s) of keys that the keys are being carried through an exit to the facility.

It is another object of this invention to provide a system for retrieving and preventing loss or theft of keys which indicates at a central location of a hospital or other health care facilities that the keys are being taken through an exit of the facilities.

SUMMARY OF THE INVENTION

These and other objects of the instant invention are achieved by providing a strong box for holding and storing drugs or narcotics in a hospital or other health care facility. Preferably, two separate keys are provided, both of which are required to obtain access to the drugs or narcotics. If a patient requires drugs, which are stored in the strong box, a call button located adjacent to the strong box is depressed. This activates a transmitter, whose signal is received by a receiver in the key, causing a beeper to operate. The carrier of the key, when the beeper operates, is "signaled" to return with the key to the location of the drug strong box, enabling the box to be opened.

In a preferred arrangement, a detector unit is mounted at preselected exits to the hospital or other facility. The detector unit transmits a signal, which is received by a receiver in the keys, and which triggers a key transmitter, which is in return received by the detecting unit. This causes a beeper to sound at the exit, thereby alerting the carrier of the key and other personnel at the exit that the key is being transported through the exit. Furthermore, a signal preferably is sent from the detector unit to a central location, which indicates the exit through which the key is being taken.

Thus, the system provides ready access to the drugs or narcotics by summoning those who are carrying the key(s) to the strong box through use of the call button and transmitter. Also, should an individual purposely or inadvertently attempt to carry the key through an exit of the facility, a beeper sounds at the exit and an indication (e.g., visible and/or audible) is provided at a central location, which identifies the exit.

BRIEF DESCRIPTION OF THE DRAWINGS

Other objects, and many of the intended advantages of this invention, will be readily appreciated as the same becomes better understood by reference to the following detailed description when considered in connection with the accompanying drawing wherein.

DESCRIPTION OF THE PREFERRED EMBODIMENT OF THE INVENTION

Figure 1:
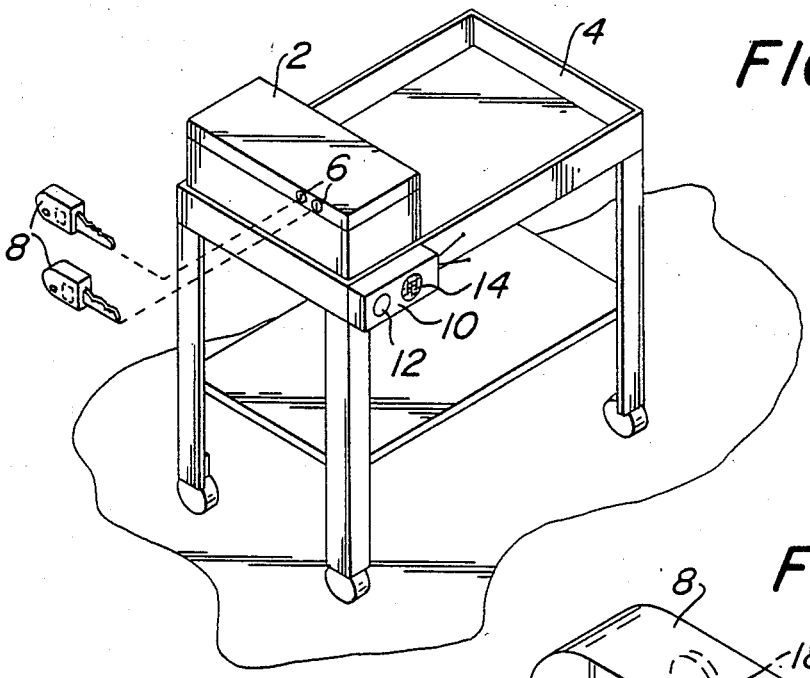
FIG. 1 is an isometric view showing, in an idealized representation, a narcotics strong box and the call button and transmitter mounted on a cart.

Referring now in greater detail to the various FIGS. of the drawings wherein like reference characters refer to like parts, there is shown in FIG. 1 a strong box 2 mounted on a cart 4. The strong box 2 holds and stores drugs or narcotics in a hospital or other health care facility. Key slots 6 are mounted on the strong box 2 for insertion of keys 8 to provide access into the strong box 2. Mounted on the cart 4 adjacent to strong box 2 is key search unit 10, which comprises a call button 12. When the call button 12 is depressed, a transmitter within control box 10 is activated, as well as a beeper, which provides an audible tone through a speaker 14.

Although the narcotics in this case are shown stored in the strong box 2 mounted on the portable cart 4, the system of this invention is equally applicable for use with various types of narcotics storage devices, including narcotics stored in cabinets or in strong boxes mounted in cabinets.

Figure 3:
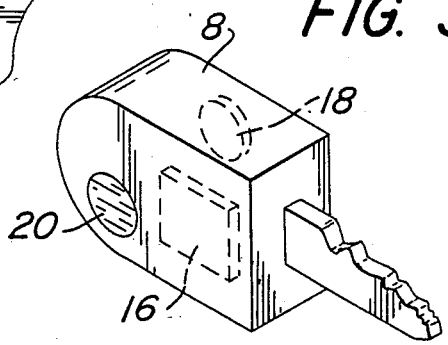
FIG. 3 is an isometric view of one of the keys allowing access to the narcotics strong box.

FIG. 3 shows a perspective view of one of the keys 8. Mounted in the key head is a printed circuit board 16, a battery 18, and a speaker 20. The printed circuit 16 includes the key receiver/transmitter shown in FIG. 6, which will be explained in detail later.

Thus, as can be seen in FIG. 1, two keys are required to provide access to the narcotics in the strong box. Should a patient require narcotics or drugs, as will be explained in detail later, depressing call button 12 will cause the key search transmitter (FIG. 5) to generate a signal which will be received by the key 8. Receiving the signal will cause the key 8 to activate a beeper, which will be heard by the carrier of the key, to instruct the carrier to return to the narcotics location because access to the narcotics is required.

Figure 2:
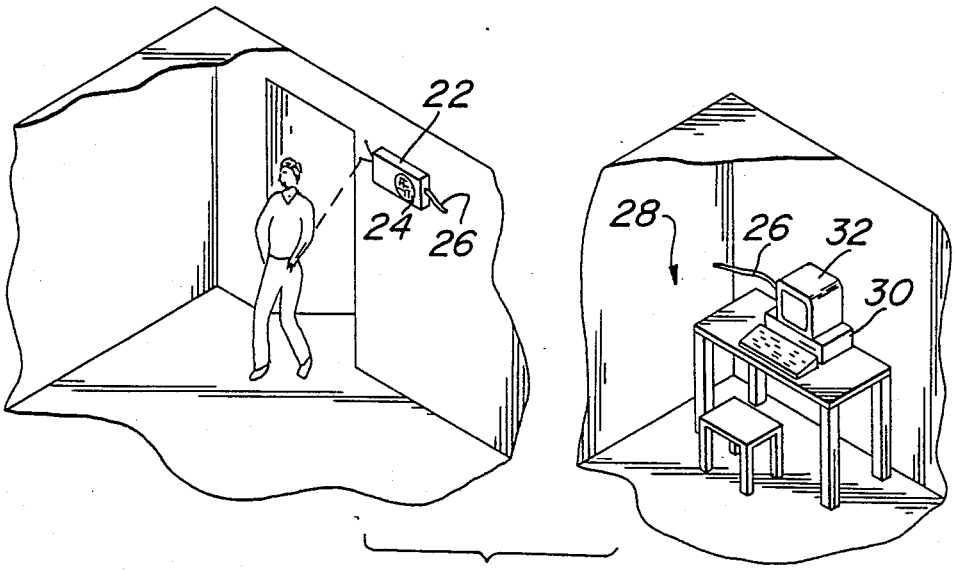
FIG. 2 shows an individual passing through an exit of a hospital or other health care facility with a detector unit mounted adjacent to the exit, and a fragmentary isometric view of a central location in the hospital or health care facility, which receives and processes a signal from the detection unit to indicate the location of the exit through which the key is being transported.
Figure 4:
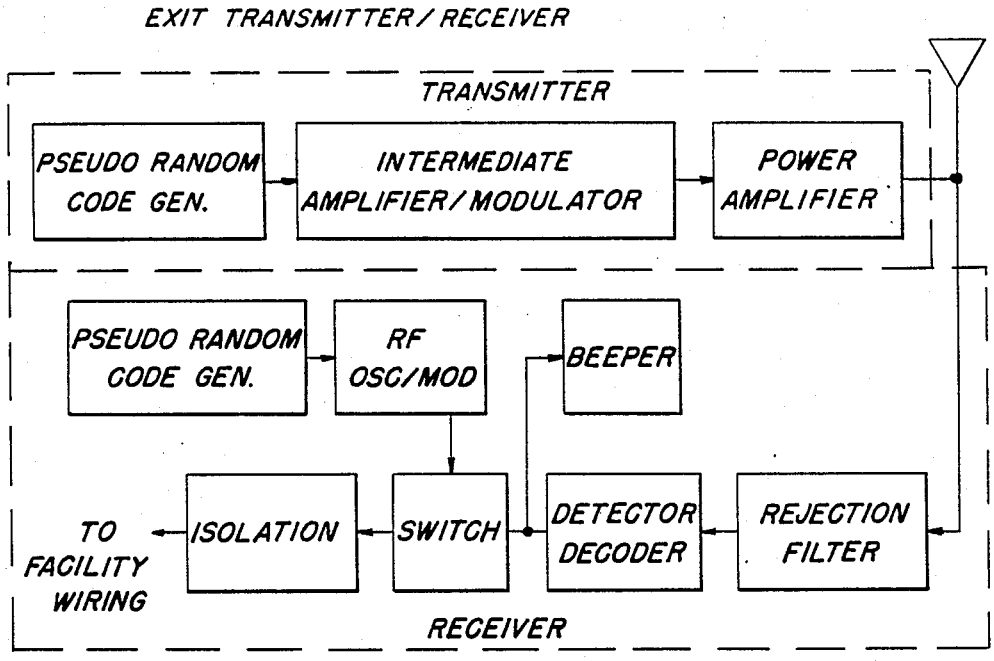
FIG. 4 is a detailed block diagram of the exit transmitter/receiver.

FIG. 2 shows a pictorial view of an individual passing through an exit to the facility. Mounted adjacent to the exit is exit detector 22, which includes speaker 24, facility wiring 26, and the exit transmitter detector (FIG. 4). The detector 22 continually transmits a low level signal. When a key passes through the exit, a receiver in the key 8 receives the detector signal and causes a transmitter in the key 8 to generate a signal which is received by the exit detector 22. This causes a beeper to generate an audio signal through speaker 24 and a signal to be conducted over facility's wiring 26 to a central location 28, which includes central receiver 30 and display 32, as shown in the right hand portion of FIG. 2. The operation of exit detector 22 in conjunction with the key 8 will be described in detail later in connection with the exit receiver/transmitter illustrated in FIG. 4, and the key receiver/transmitter illustrated in FIG. 6.

Figure 5:
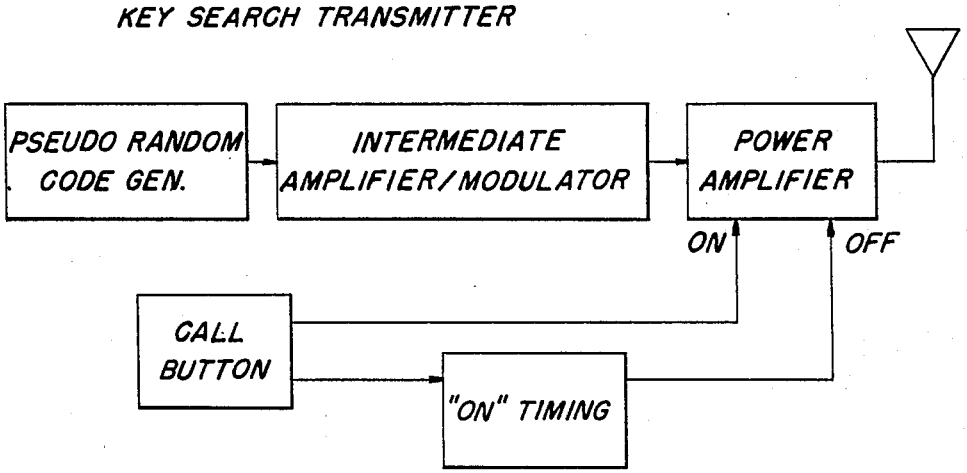
FIG. 5 is a block diagram of the key search receiver/-transmitter located adjacent the strong box.

Referring now to FIGS. 1 and 5, the operation of the key search unit 10 will be described. FIG. 5 shows a block diagram of the key search transmitter, which is installed in the key search unit 10. A pseudo-random code generator provides a coded signal to an intermediate amplifier/modulator and thence to a power amplifier. Depression of the call button turns on the power amplifier, which allows a radio signal to be transmitted through the antenna. The "on" timing allows the power amplifier to remain on for a specified amount of time only, before automatically turning the power amplifier off.

Figure 6:
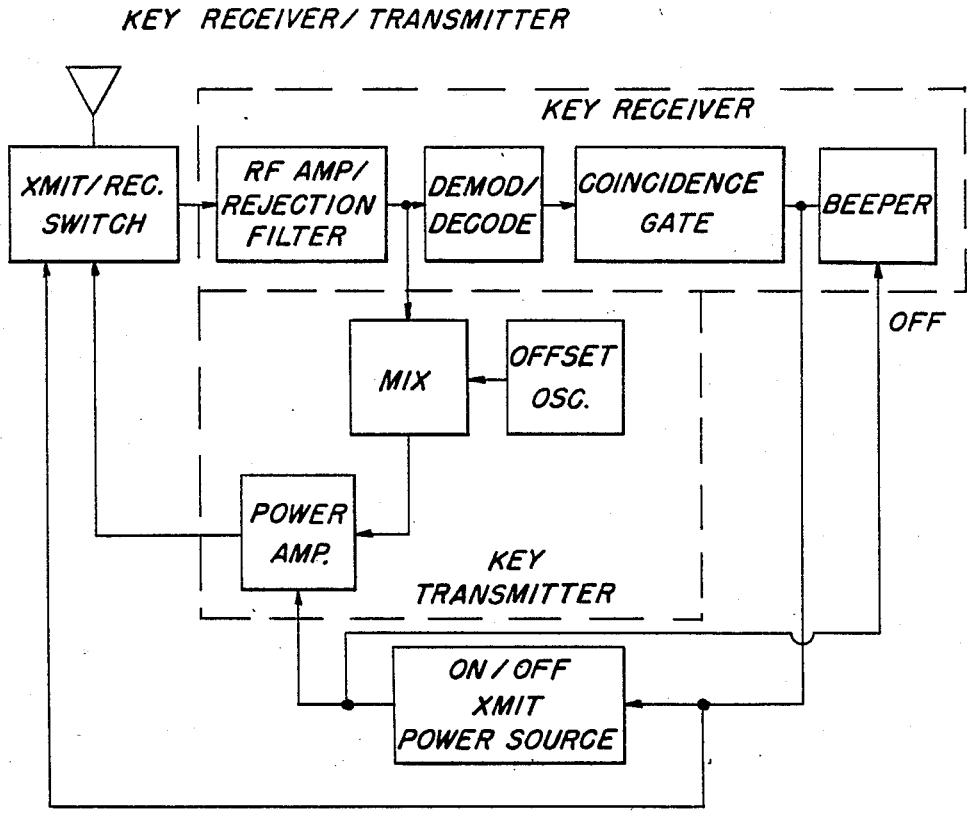
FIG. 6 is a block diagram of the key receiver/transmitter.

The key transmitter/receiver circuitry on the printed circuit board 16 is shown in FIG. 6. The signal from the key search transmitter is received through the antenna and passes through the transmit/receive switch. The received signal is then sent through an RF amplifier. Included with the RF amplifier is a rejection filter which rejects frequencies outside the normal transmitted band of frequencies of the search transmitter. The demodulator strips out of the RF signal the intelligence and sends it through the decoder portion. The coincidence gate assures that only the expected code will enable the beeper to operate. Activation of the beeper provides an audible signal to instruct the carrier of the key to return to the location of the strong box.

The call feature described above for summoning the person(s) carrying the key(s) to the strong box is of particular importance in hospitals and other health care facilities, because of the possibility that the drugs or narcotics may be required when one or more of the key holders are at various locations, such as rest rooms, cafeterias, patient rooms, and the like. The on/off transmitter power source provides a signal to automatically turn the beeper off after the passage of a preset period of time.

The transmitter portion of FIG. 6, which includes the mixer, the offset oscillator, the on/off transmitter power source and the power amplifier, will be explained below in conjunction with the operation of the exit transmitter/receiver of FIG. 4.

Referring now to FIGS. 2, 4, and 6, when an individual carrying the key 8 passes through an exit, the key receiver of FIG. 6 receives a signal transmitted by the exit transmitter of FIG. 4. The exit transmitter comprises a pseudo-random code generator, which is typically implemented by an 8-bit shift register, where the state of each bit can be hand wired or set in by a set of digi-switches. The code set in the exit transmitter is also set in the key search transmitter, as well as the key receiver. The output of the code generator is fed through an intermediate amplifier modulator, which prepares the signal for power amplification and transmission through the power amplifier block and then through the antenna.

Referring now to FIG. 6, reception by the key receiver of the exit transmitter signal passes through the transmit/receive switch and the RF amplifier through the mixer. Connected to the mixer is an offset oscillator, which offsets the frequency of the incoming signal to provide a transmitted frequency offset from the received frequency. The output of the coincidence gate of the receiver operates the on/off transmitter power source, which provides power to the power amplifier and causes a signal to be transmitted, which is offset in frequency from the received signal. The on/off transmitter power source times out in approximately one second, which provides a very low duty cycle enabling efficient battery operation of the key transmitter.

Referring again to FIG. 4, the signal transmitted by the key transmitter is received through the antenna, and then passes through the rejection filter and detector decoder. The decoded signal operates a switch, which allows a coded RF signal to be connected to facility wiring. The RF signal is specifically coded by the pseudo random generator to identify the exit where the detector is mounted and is conducted to the central location 28 to indicate that a key is being taken through a particular exit.

Figure 7:
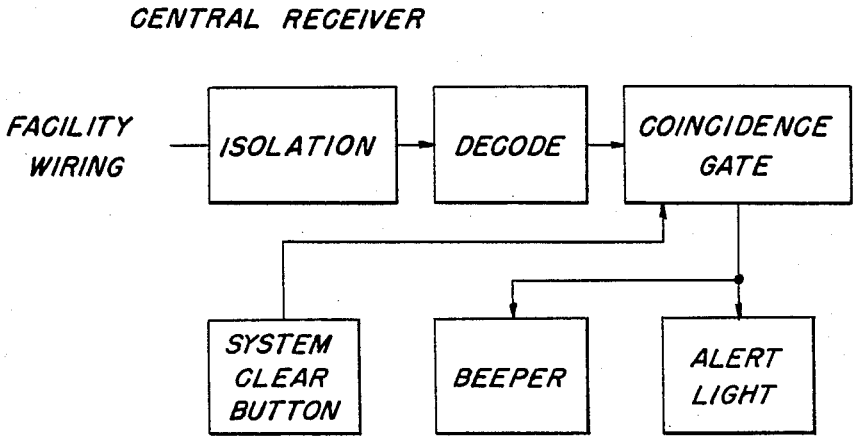
FIG. 7 is a block diagram of the receiver at the central location.

The operation of the central receiver 30 will now be described in detail in connection with FIG. 7. The facility wiring 26, which connects to each of the exits detectors, carries the exit transmitter signal to the central receiver 30. The signal first passes through isolation circuitry and is then decoded. As stated previously, each exit detector employs a different code so that when the output of the decoder is passed through the coincidence gate, it detects which of the codes of the various exit transmitters it has received and turns on the alert light associated with a specific exit. The output of the coincidence gate also turns on a beeper, which generates an audible alarm. The system clear button clears the coincidence gate and alert lights.

It should be noted that the transmitted power from the exit transmitter, which is on continually, is fairly low so as not to cause the key receiver beeper to operate unless the key is brought through or very close to on of the exits.

The above system can be easily constructed by one skilled in the art using readily available standard parts. It allows for security in the handling of drugs at hospitals and other health care facilities, while at the same time assuring rapid access to the drugs when required. The two key system assures security while the call and exit alert system keeps track of the keys and permits access to the keys when required.

Without further elaboration, the foregoing will so fully illustrate the invention that others may, by applying current or future knowledge, readily adapt the same for use under various conditions of service.

What is claimed is:

1. A system for retrieving and preventing loss or theft of keys comprising:

A. a strong box;

B. a means for opening and locking said strong box comprising:

(1) at least one key slot; and (2) at least one key, each of said at least one keys associated with, and operable with, one of each of said at least one key slots;

C. a means for transmitting a signal to each one of said keys; and

D. a retrieval means responsive to said signal associated with each one of said keys for alerting the holder of each one of said keys to return said key to said strong box.

2. The system of claim 1 wherein said at least one key slot comprises two key slots and said at least one key comprises two keys, each of said keys operating with a corresponding key slot and the operation of both of said keys being required to open said strong box.

3. The system of claim 1 wherein said means for transmitting a signal to each one of said keys comprises:

A. a key search unit mounted adjacent said strong box, said key search unit comprising:

(1) a call button;

(2) a key search transmitter operated by activation of said call button to transmit a radio signal; and (3) a beeper and a speaker, which produce an audible tone when said transmitter is operated.

4. The system of claim 3 wherein said means to alert said holder of each one of said keys comprises:

A. a key receiver for receiving and processing said radio signal; and

B. a beeper and speaker generating an audible tone initiated by said processed signal, said key receiver, beeper, and speaker being mounted in each one of said keys.

5. The system of claim 4, further comprising a detecting means for detecting the passage of each one of said keys through preselected exits.

6. The system of claim 5 wherein said detecting means comprises:

A. an exit detector mounted adjacent each one of said exits, said exit detector comprising:

(1) a detector transmitter which transmits a second radio signal; and (2) a detector receiver which receives and processes a third radio signal; and B. a key transmitter mounted in each of said keys, said key transmitter generating said third radio signal and being initiated when said key receiver receives said second radio signal transmitted by said detector transmitter.

7. The system of claim 6 wherein said system further includes a means for alerting persons in the vicinity of each of said predetermined exits when one of said keys has been detected by said detecting means at said exit.

8. The system of claim 7 wherein said means for alerting persons in the vicinity of each of said predetermined exits comprises a beeper and a speaker mounted in said exit detector, which are activated by said processed third radio signal, to generate an audio tone.

9. The system of claim 8 wherein said system further comprises a means for conducting said third radio signal to a central location, said conducting means comprising facility wiring.

10. The system of claim 9 wherein said central location comprises a means for receiving and processing said third radio signal and a means for showing the detection of, and the location of, said key detected at one of said predetermined exits.

11. The system of claim 10 wherein said means for indicating the detection and location of said key comprises an audio signal and a display.

12. A system for retrieving and preventing loss or theft of keys comprising:

A. a strong box;

B. a means for opening and locking said strong box comprising:

(1) at least one key slot; and (2) at least one key, each of said at least one keys associated with, and operable with, one of each of said at least one key slots;

C. a means for transmitting a signal to each one of said keys;

D. a retrieval means responsive to said signal for alerting the holder of each one of said keys to return said key to said strong box;

E. a means for detecting the passage of one of said keys through preselected exits;

F. a means for alerting persons in the vicinity of each of said preselected exits when one of said at least one key has been detected by said detecting means at said exit;

G. a means for transmitting a signal to a central monitoring location when one of said at least one key has been detected at one of said preselected exits; and H. a means for processing said transmitted signal received at central monitoring location, said processed signal providing an audible alarm and operating a display indicating the particular exit where said key has been detected.

13. The system of claim 12 wherein said at least one key slot comprises two key slots and said at least one key comprises two keys, each of said keys operating with a corresponding key slot and the operation of both of said keys being required to open said strong box.

14. The system of claim 13 wherein said means for transmitting a signal to each of said keys comprises:

A. a key search unit mounted adjacent said strong box, said key search unit comprising:

(1) a call button;

(2) a key search transmitter operated by depressing said call button, which transmits a radio signal; and (3) a beeper and a speaker, which produce an audible tone when said transmitter is operated.

15. The system of claim 14 wherein said retrieval means for alerting said holder of each one of said keys comprises:

A. a key receiver for receiving and processing said radio signal; and

B. a beeper and speaker generating an audible tone initiated by said processed signal, said key receiver, beeper, and speaker being mounted in each one of said keys.

16. The system of claim 15 wherein said detecting means comprises:

A. an exit detector mounted adjacent each one of said exit, said exit detector comprising:

(1) a detector transmitter which transmits a second radio signal; and (2) a detector receiver which receives and processes a third radio signal; and B. a key transmitter mounted in each of said keys, said key transmitter generating said third radio signal and being initiated when said key receiver receives said second radio signal transmitted by said detector transmitter.

17. The system of claim 16 wherein said means for alerting persons in the vicinity of one of said predetermined exits comprises a beeper and a speaker mounted in said detector, which are activated by said processed third radio signal, to generate an audio tone.

18. The system of claim 17 wherein said means for conducting said third radio signal to a central location comprises facility wiring.

19. A system for retrieving and preventing loss or theft of keys which provide access to narcotics in hospitals or other health care facilities, said system comprising:

A. a strong box holding said narcotics;

B. a means for opening and locking said strong box comprising:

(1) at, least one key slot; and (2) at least one key, each of said at least one keys associated with, and operable with, one of each of said at least one key slots;

C. a means of transmitting a signal to each one of said keys;

D. a retrieval means responsive to said signal for alerting the holder of each one of said keys to return said key to said strong box;

E. a means for detecting the passage of one of said keys through preselected exits;

F. a means for alerting persons in the vicinity of each of said preselected exits when one of said at least one key has been detected by said detecting means at said exit;

G. a means for transmitting a signal to a central monitoring location when one of said at least one key has been detected one of said preselected exits; and H. a means for processing said transmitted signal received at a central monitoring location, said processed signal providing an audible alarm and operating a display indicating the particular exit where said key has been detected.

20. A system for retrieving and preventing loss or theft of keys comprising:

A. a strong box;

B. a means for opening and locking said strong box comprising:

(1) at least one key slot; and (2) at least one key, each of said at least one keys associated with, and operable with, one of each of said at least one key slots;

C. a means responsive to said signal for transmitting a signal to each one of said keys;

D. a retrieval means for alerting the holder of each one of said keys to return said key to said strong box; and E. a means for detecting the passage of one of said keys through at least one preselected area, such as a preselected exit.

21. The system of claim 20 further including a means for transmitting a signal to a central monitoring location when of said at least one key has been detected at one of said preselected areas.

22. The system of claim 20 wherein said means for transmitting a signal to each of said keys includes a key search unit including a search transmiter for transmitting a radio signal; said retrieval means for alerting the holder of each one of said including a key receiver for receiving and process radio signal and a beeper and speaker generating an tone initiated by said processed signal, said key receiver, beeper, and speaker being mounted in each one of said keys.

23. The system of claim 22 wherein said detecting means comprises a detector mounted adjacent said at least one of said preselected areas, said detector including a detector transmitter, and a detector receiver, said detector transmitter being operable for transmitting a second radio signal, said detector receiver being operable for receiving and processing a third radio signal, and said key comprises a key transmitter being mounted in each of said keys for generating said third radio signal in response to said key receiver receiving said second radio signal transmitted by said detector transmitter.

* * * * *